US005086823A

United States Patent [19]

Danchulis et al.

[11] Patent Number: 5,086,823

[45] Date of Patent: Feb. 11, 1992

[54] ONE-PIECE LOUVER FOR A LOUVERED COVERING SYSTEM

[75] Inventors: James E. Danchulis, Pittsburgh; Robert A. Walde, Allison Park, both of Pa.

[73] Assignee: Allied Extrusions, Deerfield Beach, Fla.

[21] Appl. No.: 540,228

[22] Filed: Jun. 19, 1990

Related U.S. Application Data

[63] Continuation-in-part of Ser. No. 380,291, Jul. 17, 1989, abandoned.

[51] Int. Cl.[5] ..... E06B 9/00

[52] U.S. Cl. ..... 160/236

[58] Field of Search ..... 160/236, 235, 168.1, 160/176.1, 166.1, 900, 107, 19, 172, 199

[56] References Cited

U.S. PATENT DOCUMENTS

| | | | |
|---|---|---|---|
| 2,812,021 | 11/1957 | Bechtler | 160/172 X |
| 3,742,648 | 7/1973 | Streeter | 160/900 X |
| 4,049,038 | 9/1977 | Hyman et al. | 160/166.1 |
| 4,195,680 | 4/1980 | Hyman et al. | 160/900 X |
| 4,254,813 | 3/1981 | Vecchiarelli | 160/19 |
| 4,427,048 | 1/1984 | Osaka et al. | 160/236 X |
| 4,434,834 | 3/1984 | Ennes | 160/236 X |
| 4,519,435 | 5/1985 | Stier | 160/236 X |
| 4,628,980 | 12/1986 | Le Houillier | 160/166.1 X |
| 4,685,502 | 8/1987 | Spangenberg | 160/107 |
| 4,773,733 | 9/1988 | Murphy et al. | 160/236 X |
| 4,842,036 | 6/1989 | Goodman | 160/166.1 |
| 4,884,615 | 12/1989 | Hsu | 160/236 |
| 4,913,216 | 4/1990 | Lemay | 160/236 |

*Primary Examiner*—David M. Purol

*Attorney, Agent, or Firm*—Joseph J. Carducci

[57] ABSTRACT

A novel one-piece louver having a flat or substantially arcuate cross-section defining thereof first and second longitudinal edges, there being no other structure depending from the first and the second longitudinal edges, suitable for use in a louvered covering system carrying on at least one face thereof and along the periphery thereof an adhesive carrying a removable protection covering.

2 Claims, 1 Drawing Sheet

ONE-PIECE LOUVER FOR A LOUVERED COVERING SYSTEM

This application is a continuation-in-part application of our U.S. Pat. Application Ser. No. 07/380,291 for Novel One-Piece Louver for a Louvered Covering System filed July 17, 1989 now abandoned.

BACKGROUND OF THE INVENTION

1. Field of the Invention

This invention relates to a novel one-piece louver, especially suitable for the preparation of a louvered covering system, carrying on at least one face thereof an adhesive carrying a removable protective covering.

2. Description of the Prior Art

Louver blinds, made, for example, from a polyvinyl chloride plastic compound (PVC), aluminum or wood, have been used extensively to cover windows, doors and other openings so as to provide privacy, control the entry of light therethrough and for their aesthetic effects. Efforts to further enhance their desired aesthetic effects have involved the application of coatings on the louver surface, attachment thereto of a laminate or the adhesion of a covering on a portion thereof.

Attempts to improve the aesthetic effects of these louvers have not always been successful. In many cases the individual louvers are subject to strong solar loads or to heat locally generated, such as heat from a furnace. Since the coefficient of thermal expansion of the individual louver and of the attached decorative covering is generally different, the louver will have a tendency to bend or warp, resulting in stress in the adhesive bond and the subsequent distortation and/or separation of the decorative covering from the louver surface. In addition, the effectiveness of the louvers to assure privacy and to control the entry of light will be reduced.

Thus, Hyman et al in their U.S. Pat. Nos. 4,049,038 and 4,195,680 disclose a louver system which includes a plastic panel provided with elongated, inwardly-turned flanges, a backing sheet disposed within the panel and held in place therein by said flanges, and a decorative member, such as wallpaper, glued to the backing sheet. Le Houillier in U.S. Pat. No. 4,628,980 realizes that louvers of the prior art provided with elongated, inwardly-turned flanges that are adapted to receive an insert therein interfere with a complete, unobstructed view of the face of such insert and proposes using a louver having flanges made of a clear transparent material. Even though Le Houillier is using a clear plastic for the holding flanges, they are still highly visible and highly disruptive to the aesthetic louver blind assembly. But Ennes in U.S. Pat. No. 4,434,834 realizes that the Hyman et al louvers are subject to warping and bending and proposes an individual louver, which also includes elongated, inwardly-turned flanges, said flanges being adapted to receive therein a resilient metallic insert having a deflection characteristic different from that of the louver, so as to provide the louver substantial strength against bending and warpage. In addition, Ennes also provides the metallic insert with elongated adhesive strips carrying a removable protective paper adapted to facilitate the attachment of wallpaper to the metallic strip.

Unfortunately, both Hyman et al and Ennes must resort to a louver composed of more than one component, adding to the overall cost of the louver. In the case of Ennes, the cost of adding the insert is particularly expensive, since the insert must have specific properties of strength and deflection, and must have specific dimensions, so as to fit properly within the elongated, inwardly-turned flanges, to be effective. Although both Hymen et al and Ennes are also interested in the aesthetic characteristics of the louvers, as well as the louver assembly, in each case the outward portions of the elongated section of the inwardly-turned flanges are always uncovered, and thus can be seen, since the decorative covering is solely applied to the inserts and not to any portion of the base panel. Thus, no uniform or overall or aesthetic effect can be obtained from the decorative coverings.

We have found that the above problems can be obviated and the louver simplified by providing a louver composed of one piece and carrying on at least one face thereof and along the periphery thereof an adhesive carrying a removable protective covering thereon.

SUMMARY OF THE INVENTION

We have discovered a novel one-piece louver that is especially suitable for the preparation of a louvered covering system that is easy to make, aesthetically pleasing and wherein the louver is resistant to warping and bending. The louver so prepared carries on at least one face thereof and along the periphery thereof an adhesive strip carrying a removable protective covering. In a preferred embodiment, at least one surface of the louver, preferably the face opposite the face carrying the adhesive and the removable protective covering, carries at least one contiguous protrusion thereon extending outwardly therefrom substantially along the length of the louver to aid in resisting warpage and bending of the louver for the purpose of increasing the stiffness thereof. In each case herein, the louver is made solely of a material selected from the group consisting of a plastic material, aluminum and wood, and each individual louver has a flat or substantially arcuate cross-section defining thereof first and second longitudinal edges, there being no other structure depending from said first and said second longitudinal edges.

BRIEF DESCRIPTION OF THE INVENTION

Figure 1:
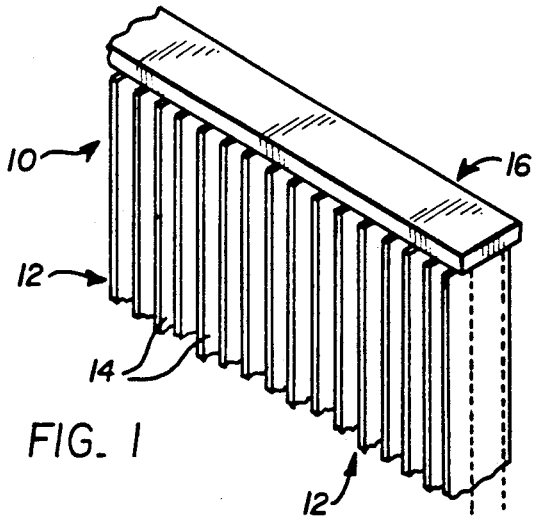
FIG. 1 is a partial view, in perspective, of the louvered covering system constructed with the aid of the unique louvers prepared in accordance with the teachings of the invention herein.
Figure 2:
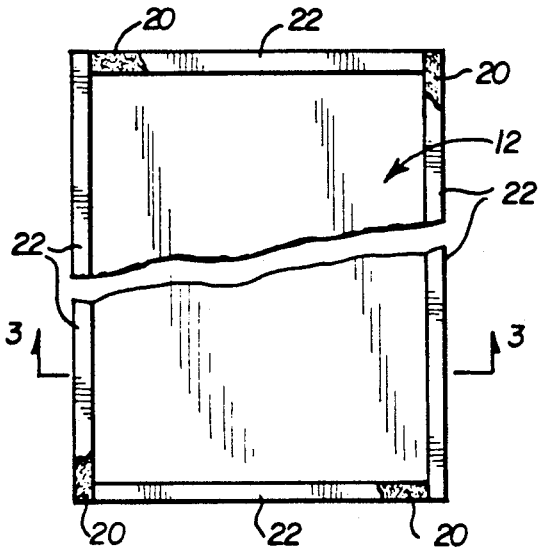
FIG. 2 is a plan view, partially broken away, of the improved louver claimed herein.
Figure 4:
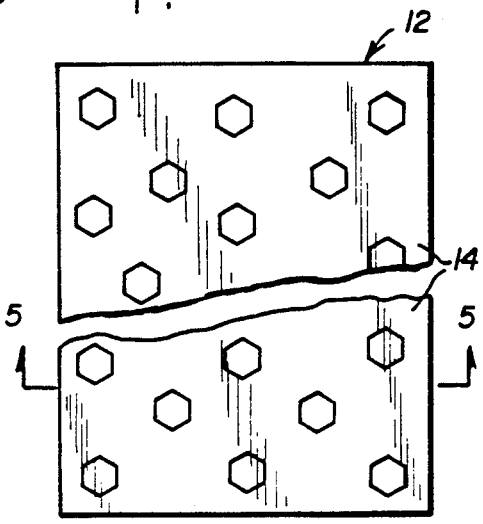
FIG. 4 is a plan view, partially broken away, of the claimed louver herein carrying on the face thereof a decorative covering.

Referring to FIG. 1, reference numberal 10 refers to a louvered covering system using a plurality of the unique louvers 12 defined and claimed herein wherein each of the louvers is covered with a decorative covering 14, as defined more fully hereinafter. The specific means for supporting the individual louvers from the horizontal support system 16 and the specific means for rotating the individual louvers about a vertical axis, generaly located in support system 16, for desired positioning of the individual louvers are not illustrated, for any such means conventionally used in the art can be employed.

Figure 3:
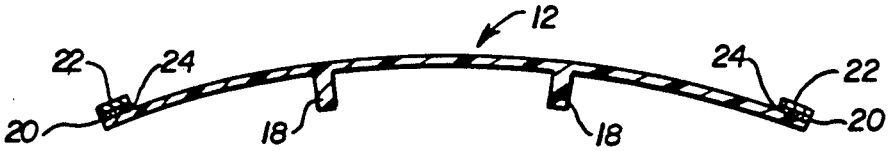
FIG. 3 is a cross-sectional end view, somewhat enlarged for clarification, taken along line 3—3 of FIG. 2.
Figure 5:
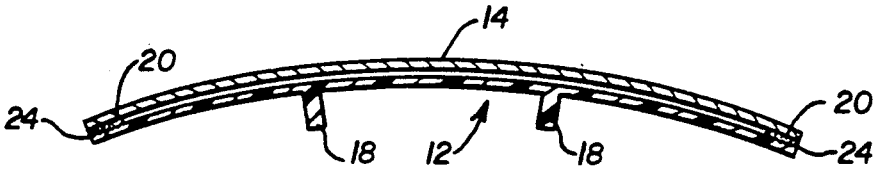
FIG. 5 is a cross-sectional end view, somewhat enlarged for clarification, taken along line 5—5 of the FIG. 4.

The individual louver 12 used herein can generally be made of any suitable or conventional plastic material (preferably PVC), aluminum or wood. When the louver 12 is made from plastic the same is normally produced by extrusion, but in the preferred embodiment herein simultaneously with at least one longitudinally-extending contiguous protrusion 18 on at least one face thereof (FIGS. 3 and 5) to increase the stiffness of the louver 12 and thereby reduce its tendency to distort and bend. Normally, when the louver 12 is made from wood or aluminum, a stiffening member is not required. The louver 12 can be flat or substantially arcuate in cross-section, but is preferably arcuate, as seen in FIGS. 3 and 5. In general the louver 12 can have a width in the range of about 1 to about 5 inches, although this can be varied as desired. Similarly, the thickness of louver 12 can be varied, although in general the thickness can be in the range of about 0.01 to about 0.10 inch. The protrusions 18 in the defined embodiment can also be varied, but, in general will range in height from about 0.05 to about 0.50 inch and in thickness between about 0.01 to about 0.10 inch. Generally, protrusions 18 extend in a range of about 0.20 to about 2.0 inches from the adjacent vertical edge of louver 12.

To the louver 12, as defined above, there is then applied, using any suitable procedure, along its periphery an adhesive strip 20. In general the adhesive strip 20, so applied, can have a width in the range of about 0.03 to about 2.0 inches, sufficient in amount to function in the manner defined hereinafter. Any suitable tacky material substance that will permanently adhere to the surface of the louver 12, releasably adhere to the protective covering 22, more fully defined below, and, finally, preferably releasably, to the decorative covering 14 can be used. Thus, adhesives suitable for use herein can be prepared from a number of so-called tacky organic polymers, such as acrylics, rubber, polyolefins, etc. Generally, the cost of the adhesive, its ease of handling and the bond strength required will dictate the choice thereof.

In a preferred embodiment, in order to maximize the adhesive bond between the adhesive strip and the adjacent surface of the louver 12 therebeneath, the adjacent surface of the louver 12 is roughened, as indicated by reference numeral 24 in FIGS. 3 and 5. Various types of surface treatments can be used, such as abrasion, using an abrasive substance, such as sandpaper or a fine abrasive which will provide excellent results.

In all cases, however, as best seen in FIGS. 3 and 5, each of the two longitudinal edges of the individual louver 12 has no other structure depending therefrom.

After the adhesive strip has been applied to the surface of louver 12, a protective strip or covering 22 is superimposed thereon. The protective covering 22 can be made of any material that can attach itself to adhesive strip 20 but, also, that can be easily removed or stripped therefrom when desired. Protective covering 22 can include, for example, silicone or flouro polymer coated paper strips.

The adhesive strip 20 may also first be applied to the removable protective covering 22, acting as a carrier for the adhesive, which is then subsequently applied to the periphery of the louver edge. The adhesive so applied in this manner has been referred to by others as a transfer adhesive tape.

When the louver 12 is to be used, the protective covering 22 is stripped off and a decorative covering 14, coextensive with the outer surface of the louver 12, is attached thereto. The strength of the bond between the protective covering 22 and the adhesive strip 20 can be substantially increased by the application of increased pressure on the protective covering 22.

The above details have been set forth above merely to illustrate an embodiment of our invention. It is understood that the louver blind 12 can be elongated as shown, or can have any desired shape. The individual louvers 12 can be mounted vertically, as shown, horizontally or in any other desired mode. Although the adhesive strip 20, and its accompanying protective covering 22, have been shown to extend continuously around the periphery of louver 12, it is understood that they can extend intermittently around the periphery thereof as long as effective attachment of decorative covering 14 to the face of louver 12 is obtained. Also, additional adhesive strips 20, and accompanying protective coverings 22, can be applied to other portions, in fact even all, of the remainder of the louver surface, if desired. This is not preferred, however, because of the additional costs involved and without any appreciable effectiveness in adhering decorative covering 14 to the surface of louver 12. What has been shown to have been done to one face of louver 12, that is, provisions for attachment of a decorative covering 14 to louver 12 and for the provisions of protrusions 18 on the face of louver 12 can also be done on both faces of louver 14 if desired.

The advantages of our novel louver can easily be seen from the above. Making louver 12 of one component alone, rather than a plurality of components, as in the aforementioned Hyman et al and Ennes patents, obviously greatly reduces the cost thereof. The decorative covering 14 being coextensive with the surface area of louver 12, provides a louver covering system having an enhanced aesthetic appeal, for, when closed, the louver covering system will display a substantially continuous decorative surface with no intervening protruding edges from the inturned flanges, even if such flanges are made of clear plastic, as shown in the prior art discussed above. And since the individual louver 12 is provided in the preferred embodiment with stiffening protrusions 18, bending or warping of the louver 14 is greatly minimized and the decorative covering 14 remains effectively adhered to the louver 12.

An individual curved louver was prepared using an extrudate of a polyvinyl chloride compound made by the B. F. Goodrich Company. The louver had a length of eight feet, an arc of curvature such that its width was 3.45 inches curved and 3.50 inches when pressed flat, a thickness of 0.03 inch and two contiguous elongated protrusions, extending along the concave face of the louver, each protrusion having a thickness of 0.025 inch and a height of 0.25 inch. The longitudinal edges of the louver, opposite the side of the protrusions, to a width of 0.25 inch, were subjected to abrasion, an adhesive strip of a tacky acrylic polymer was applied to the abraded surface on a silicone polymer coated kraft paper backing. Later, the silicone polymer-coated kraft paper was stripped off the surface of the louver, the adhesive, however, being retained on the surface of the louver, and a decorative fabric composed of polyester and coextensive with the surface of the louver pressure attached to such surface through the medium of the adhesive left on the louver surface. The resulting louver possessed a desirable aesthetic appeal.

Obviously, many modifications and variations of the invention, as hereinabove set forth, can be made without departing from the spirit and scope thereof, and therefore only such limitations should be imposed as are indicated in the appended claims.

We claim:

1. A novel elongated louver made of a material selected from the group consisting of a plastic material, aluminum and wood having a flat or substantially arcuate cross-section defining thereof first and second longitudinal edges, there being no other structure depending from said first and said second longitudinal edges, suitable for use in a louvered covering system, carrying on at least one face thereof along the vertical edges thereof an adhesive carrying a removable protective covering, said louver being provided with at least one elongated, contiguous protrusion extending outwardly from a surface of said louver.

2. The louver of claim 1 wherein said protrusion extends outwardly from the face of said louver opposite the face carrying said adhesive and said removable covering.

* * * * *